United States Patent [19]

Ansen et al.

[11] 4,236,886

[45] Dec. 2, 1980

[54] METHOD AND APPARATUS FOR THE PRODUCTION OF COALDUST

[75] Inventors: Jakob Ansen, Cologne; Heinz Hoppen, Overath-Steinenbrück; Helmut Duill, Cologne, all of Fed. Rep. of Germany

[73] Assignee: Klöckner-Humboldt-Wedag AG, Fed. Rep. of Germany

[21] Appl. No.: 949,952

[22] Filed: Oct. 10, 1978

[30] Foreign Application Priority Data

Oct. 8, 1977 [DE] Fed. Rep. of Germany ..... 2745425

[51] Int. Cl.[3] ..... F27B 15/00

[52] U.S. Cl. ..... 432/14; 110/106; 110/232; 110/263; 110/347; 432/58

[58] Field of Search ..... 110/347, 263, 232, 233, 110/106, 229; 432/14, 15, 16, 58, 106

[56] References Cited

U.S. PATENT DOCUMENTS 4,059,060 11/1977 Gambs et al. ..... 110/347 X 4,152,110 5/1979 Jukkula et al. ..... 432/14

*Primary Examiner*—Edward G. Favors

*Attorney, Agent, or Firm*—Hill, VanSanten, Steadman, Chiara & Simpson

[57] ABSTRACT

A method and apparatus for the preparation of coaldust for use with a preheater and a cement calcination apparatus. Exhaust gas from the preheater is mixed with a source of coal and input to a pulverizing mill. The output of the pulverizing mill passes through an air current separator and a cyclone separator. The output of the air-current-separator, a stream of coal gravel, is supplied as a fuel at a calcination point in the calcination apparatus. The exhaust output from the separator provides an input to the cyclone separator which separates coaldust from the gas. The exhaust from the cyclone separator is in part fed-back to a calcination point in the calcination apparatus and is also a part of the stream of gravel. The entire process is closed so that no burnable coaldust is lost to the atmosphere.

23 Claims, 1 Drawing Figure

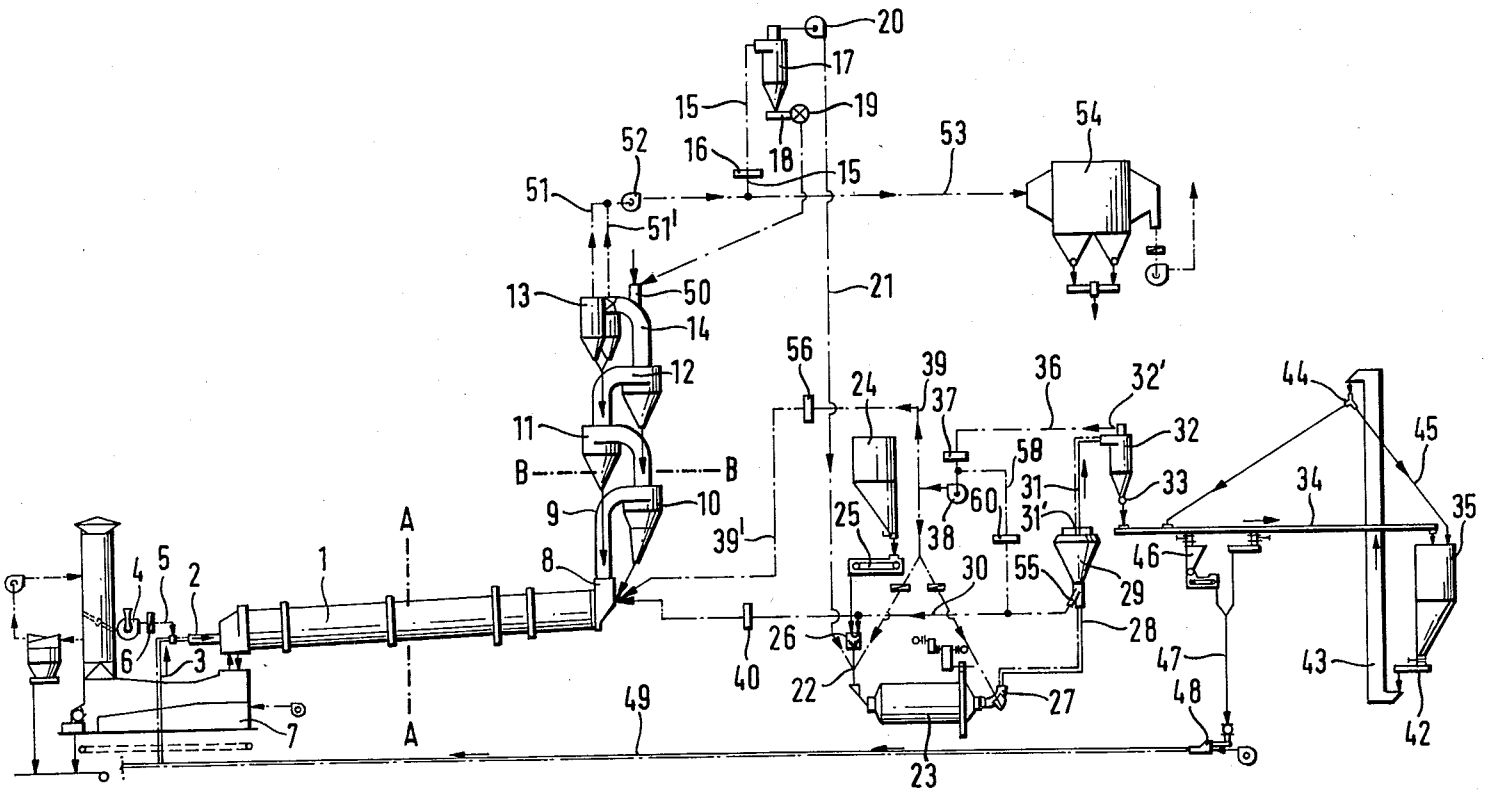

METHOD AND APPARATUS FOR THE PRODUCTION OF COALDUST

BACKGROUND OF THE INVENTION

1. Field of the Invention

The invention relates to a method as well as an apparatus for the preparation of coal for firing of a calcination installation consisting of preheating stage, calcination stage as well as sintering stage, particularly for the production of cement clinker, in an air-current-pulverizing-drying-installation.

2. The Prior Art

There are several ways to relate apparatus for the drying and fine-grinding of coal with a calcination installation of the noted type. For example, installations are known, in which with respect to the grinding-drying apparatus, of a cement installation, a place was selected in the vicinity of the calcination, whereby it was proposed to deflect the required milling-recirculated air from the hot exhaust gas of the clinker-cooler-system. Such an installation is for example shown and described in the block circuit diagram FIG. 14 Zement-Kalk-Gips (Cement-Lime-Gypsum) (ZKG) 1956, Vol. 11, page 491.

The known arrangement is in itself uncomplicated, sturdy and supervisable. However, there are always limits to it's use when types of coal are processed with particularly high portions of volatile constituents. The advantageous position on the calcination side, however, is also put into question when for example additional calcination points must likewise be supplied with coal from the grinding or pulverizing installation.

SUMMARY OF THE INVENTION

The present invention is a method and an apparatus for the drying and fine grinding or pulverization of coal for the supply of coaldust for firing of a calcination installation. The calcination installation comprises a preheating stage, a calcination stage and a sintering stage for the production of cement. The inventive apparatus is to be integrated with the calcination installation so that with respect to the installation as a whole, optimal operating conditions result, particularly with regard to the economy and safety in operation.

The inventive apparatus blows the grinding-exhaust-air (from the coal pulverization) into the calcination stage.

This results in the advantage that the rotary kiln is at least partially relieved with respect to the stationary cyclone system, forming at least a part of the calcination stage, as well as the preheating stage, of the basic charging of the installation with calcination- and reaction-gases.

In the present embodiment of the invention, there results the further advantage that the mill-exhaust-air, at least partially laden with residual coaldust, is blown unfiltered into the calcination stage.

A further significant advantage is attained by another measure essential to the invention. The exhaust air, before injection, is enriched with coal to a solids content between about 30 g/m$^3$ and about 300 g/m$^3$. The degree enrichment is undertaken according to the measure of the temperature increase of the exhaust air attained through combustion of the coal content.

It is known that to operate a calcination installation with the greatest possible economy, for the production of cement clinker, at least a part of the heat requirement of the calcination stage is provided by means of additional heating in the area of this calcination stage. The invention takes this fact into account and takes advantage of the fact that the pulverizing exhaust air which occurs with a temperature of about 100° C. as well as with a portion of water vapor on the order of 5 to 15%, may be brought through combustion of the portion of fine coal contained in it to a temperature level which corresponds to the temperature level at the introduction point of the calcination stage. There, for example, temperatures between 800°and 1200° C. may be found. It was determined by computation and experimentally, that about 10 grams of high-valent fuel brings about in a cubic meter of air upon combustion, a temperature rise of the gas of about 100° C.

On the basis of these considerations, the inventive apparatus enriches the milling-exhaust air with coal-solids-contents of about 100 grams for each cubic meter of volume in order through the combustion to attain an average gas temperature of approximately 1000° C. However, at times it may be advantageous for the fulfilling of the heating requirement for at least a part of the endothermic process of the calcination to introduce still more additional fuel into the calcination stage. In this case, the exhaust air may be at least partly enriched with a gravel mixture containing minerals, rock and coal.

From this results the further advantage that not only is the mill relieved of the grinding work for the comminution of this gravel portion to flour or dust consistency, but, the coal in the condition of small pieces, is introduced into the calcination stage. Experience indicates that favorable combustion conditions result in this case if a spontaneous reaction is prevented between fuel and oxygen at the place of entry, and a delayed combustion is aimed at.

In this connection in the embodiment of the invention, it is desirable that the gravel mixture be removed from the air current separator with relatively high moisture, for example, with 5% to 8% moisture.

On account of the favorable operating prerequisites already mentioned for the air current mill, in this connection the removal of gas may be provided at a point of relatively low temperature level, for example, by means of tapping of the exhaust gas conduit attached to the preheating stage.

In this connection, use may be made with advantage of the measure that the grinding drying installation on the gas side is attached or connected at two points of different temperature level. As a result, the temperature of the inert drying gas may be easily adjusted in the mill circulation through mixture of gases of different temperature.

An apparatus for carrying out the method according to the invention has an exhaust air conduit, which discharges in the calcination stage of the calcination installation.

In addition, the apparatus is equipped with advantage so that it has at least one gas-feed-conduit between the mill-inlet and the preheating- and/or calcination stage, as well as, if need be, an exhaust gas conduit connected thereto.

For the regulating capacity of such an apparatus, it is of advantage that both in the gas supply conduit or conduits as well as also in the outlet conduit, in each case a gas-conveyor-blower is provided and advantageously in each case a setting member for the regulation of the gas quantities.

Furthermore, the apparatus has a conveyor device, advantageously at least one connection conduit between the gravel discharge of the air current separator and at least one additional burning or calcination point in the area of the calcination stage of the calcination installation, which possesses at least one setting member for the regulation of quantities.

Furthermore, the apparatus is characterized by a conveyor device, advantageously a conveyor conduit, between the gravel discharge of the air-current-separator and the suction side of the blower of the exhaust air conduit, with a regulating member advantageously arranged therein.

And finally, there results for an optimal integration of the air-current-grinding installation with the further installation parts, an advantageous Lay-Out, thereby, that the grinding-drying installation is arranged in the most direct vicinity of the preheating stage, and is integrated spatially as well as functionally with the preheating- and/or calcination stage into a function- and structural unit.

In summary the inventive method comprises the steps of tapping off of one or more gas outputs of an associated calcination or preheater apparatus, mixing the coal with the input gas, pulverizing the coal, separating the pulverized coal into at least a stream of coaldust and a stream of exhaust gas, and blowing the exhaust gas still carrying residual coaldust into the calcination stage.

The exhaust gas may also be enriched or charged with coal gravel before being blown into the calcination stage. In this case, it is desirable that the exhaust gas be enriched with coal solids to within a range of 30 grams per cubic meter to 300 grams per cubic meter. The exact degree of enrichment undertaken is determined by the extent of temperature increased in the exhaust gas which may be attained by means of the combustion of the coal content.

The inventive method may further include the step of separating pulverized coal into a stream of gravel, a stream of dry coaldust, and a stream of exhaust gas still bearing a selected amount of unseparated or residual coaldust, mixing at least some of the exhaust gas with the stream of gravel for improved burning, injecting at least some of the exhaust gas into the pulverizer and transporting at least some of the exhaust gas into an exhaust gas receiving apparatus for the therein. It is desirable that the stream of gravel have a moisture content within a range of 5% to 8%.

Within the inventive method it is also possible to take the input gas from two different sources each of which provides gas of a different temperature. By mixing the gases of the different temperatures, the input gas utilized in the method may be set to any predetermined value.

The apparatus for practicing the present invention comprises means for pulverizing the coal, means for separating the pulverized coal into at least coaldust and exhaust gas, and means for injecting the exhaust gas into the calcination stage of the installation.

The means for pulverizing may include a pulverizing mill having both an input port and an output port. The means for separating may include an apparatus for separating out gravel which may be used in part to charge the exhaust gas with coal gravel before it is injected into the calcination stage.

BRIEF DESCRIPTION OF THE DRAWING

The FIGURE is a block diagram of a preheater and calcination apparatus including a rotary kiln incorporating the coal preparation method and apparatus of the present invention.

DETAILED DESCRIPTION OF THE PREFERRED EMBODIMENT

While the apparatus of the present invention finds a particularity utility for the production of coaldust, the present apparatus might be utilized in other combinations. By way of disclosing the best mode of practicing the invention and not of limitation, there is shown generally in FIG. 1 a block diagram of a calcination installation for the production of cement clinker with the inventive air-current-pulverizing installation for the supply of coaldust.

The installation has a rotary kiln 1 whose burner 2 is supplied with coaldust from a conduit 3 as well as with primary air from a blower 4 by way of a conduit 5 and a throttle-member 6. With the kiln 1 is connected in series on the product side, a clinker-cooler 7, whose cooling air in a conventional fashion is introduced as hot secondary air entirely or preponderantly into the rotary kiln 1. At the other end of the rotary kiln 1 is located a furnace inlet 8, with which is connected an exhaust gas conduit 9. The conduit 9 discharges tangentially into a cyclone separator 10 of the heat exchanger system. A set of three additional heat-exchanger-cyclone stages 11, 12, 13 are attached to each other in a standard fashion and to the separator 10. Units 10–13 along with the kiln 1 comprise the calcination installation.

In the present example installation, the cyclones 11–13 of the heat exchanger system form the preheating stage, while the calcination stage comprises the area between the section line B—B and A—A, that is, the heat exchanger cyclone 10 as well as the part of the rotary kiln between furnace inlet 8 and approximately the middle of the kiln 1.

The sintering stage reaches approximately from the section line A—A to the radiation zone of the flame of the burner 2.

There are attached to the twin-heat-exchanger 13 a pair of exhaust gas conduits 51, 51', leading to the suction side of an exhaust-gas-blower 52. An exhaust gas conduit 53 leads from the blower 52 to a dust-removing device, in the present case, an electro-filter 54.

There is attached to the exhaust gas conduit 53, a deflecting conduit 15, which leads through a throttle member 16 to a separator cyclone 17. The cyclone 17 guides the separated-out solid pulverized raw material to be used in the manufacture of cement back through a discharge member 18 and a star or bucket-wheel charging valve 19 to a pulverized raw material charge 50 of the preheating stage. From the high-output-separator 17, a pure gas conduit leads to the suction side of a blower 20. The output of the blower 20 is an exhaust port for the calcination installation and the inert gas sucked off of the exhaust gas conduit 53 is conducted through a conduit 21 to a charging side 22 of a tube mill 23.

The gas removed has for example a temperature level of about 330° C. It contains approximately 3% to 4% of free oxygen and has a $CO_2$ content on the order of 28 to 33%.

In this condition the gas, both from the standpoint of inertness as well as also from the standpoint of the heat content is best adapted to utilization in the air current pulverizing installation. This is particularly so if one takes into consideration that a substantial advantage results with the invention in that moist gravel is deflected from the grinding or pulverizing installation and is injected as additional fuel with the grinding or pulverizing exhaust air or perhaps by separate burners into the calcination stage.

The air flow-pulverizing installation itself comprises a raw coal bunker 24 with a regulating discharge member 25, to form a regulated supply of coal. The member 25 delivers raw coal through a gas-tight double-governor-charging valve 26 into the inlet 22 of the tube mill 23.

The feed or supply conduit 21 for the inert gas also discharges into the inlet 22, thereby mixing the gas with the coal. A vertical shaft 28 is attached to a mill outlet 27. The shaft 28 discharges into a first or air current separator 29. The separator 29 has an output port or gravel outlet 55 which furnishes through a conveyor device, for example, in the form of a connecting conduit 30 having a regulating member 40 located therein, gravel into the furnace inlet 8 of the rotary kiln 1, that is, into the calcination stage of the calcination installation.

It is essential to the invention that the exhaust air in the mill 23 sucked up through a finished material conduit 31 connected to an exhaust port 31' of the separator 29 through a second separator 32, through an exhaust port 32' to a pure gas conduit 36, through a regulating member 37 arranged therein, and through a blower 38, is guided back through a connecting conduit 39, 39' with a regulating member 56 arranged therein into the calcination stage 8, 9, 10. By this means, not only is dust removal or loss prevented in this gas portion, but the equilibrium in the gas content of the calcination installation is improved in favor of the calcination stage and accordingly optimizes the economy.

The pulverized and dry coaldust is discharged from the separator cyclone 32 through a gastight star or bucket-wheel-discharge valve 33 onto a conveyor device 34. The conveyor 34 then transports the coaldust into a coaldust bunker 35. The latter possesses a rotating device which comprises a regulating discharge member 42, an elevator 43 as well as a material divider 44 and a return conduit 45.

From the conveyor member 34 branches off a controlled removal apparatus 46, which with a drop conduit 47 transports coaldust into a dust conveyor installation 48. From there, the coaldust is injected through a conduit 49, via the conduit 3 into the burner 2 of the rotary kiln 1.

For improved regulation, there is arranged in the conduit 39 for the grinding exhaust air a regulating member 56.

It is important and is therefore brought out here that the introduction both of the grinding exhaust air via the conduit 39', as well as of additional coal, via the gravel conduit 30, may be carried out at the same point or at different points in the area of the entire calcination stage.

In this connection the solids content of coal in the grinding exhaust gas conduit 39' is influenced, either through coarsening of the degree of separation of the separator 32 and/or through corresponding adjustment of the air separator 29.

It is, however, also provided with the invention that the apparatus has an intermediary conduit or connection 58 between the output port or gravel discharge 55 and the suction side of the ventilator 38 whereby gravel may be charged into the exhaust air conduit 39. The quantity of the gravel feed is adjusted with a regulating member 60.

The installation shown purely diagrammatically as a block circuit diagram shows the essential features of the invention which consist therein, that the grinding drying installation guides back the grinding exhaust air unfiltered and according to the measure of the particular conditions of operation, if need be, with more or less high enrichment or concentration of pneumatically conveyed fine coal into the calcination stage of the calcination installation, while, on the other hand, the mill removes inert drying gas of sufficient heat content with corresponding temperature level at one point such as the output of the blower 21 or more points such as the output of the blower 21 as well as at a junction 65 via a conduit 70. The two gas streams may be mixed at a mixing junction 75.

Thereby results an optimal spatial and functional integration of the two installation parts cooperating as entity, namely, the air current grinding installation and the calcination installation, thereby, that the grinding drying installation is arranged in the most direct vicinity possible of the preheating step.

Thereby results favorable, because they are shortest, connections, and this again leads to the fact that the material-conveying conduits may be carried out with steep drops for example on the shortest path, as so-called drop-conduits, whereby the danger is excluded that at any point such conduits could form dust-deposits.

The return of unfiltered grinding exhaust air beyond this saves filter capacity and accordingly the investment costs of the filter, as well as its operating costs such as maintenance and supervision.

Additionally, through the deflection of coaldust and finely divided carbon or carbon dust from the mill circulation the mill and its circulation are appreciably relieved, which contribute not inconsiderably to an increase in the economy of the total installation.

And finally, the position of the grinding installation in direct vicinity of the calcination stage, results in the possibility of operating the mill, partially at least, as an injection-direct-feeding mill for possible additional calcination points in the area of the calcination stage, whereby the calcination process may be optimized and controlled in advantageous manner.

The block-circuit diagram shown in the drawing and described in the foregoing, of an installation may with maintenance of the features essential to the invention, be modified as follows.

The air-current-grinding installation, may be equipped instead of a tube mill with other comminution machines such as beater mills, impact pulverizers or hammer-mills.

The deflection of drying gas for the operation of the grinding installation may for example take place both from a desired point within the preheating system, for example, from the connecting conduit 14 of the two cyclones 12, 13, or also from a point in the exhaust gas conduit 53, or from several place, at the same time.

While those skilled in the art might suggest various modifications and changes, it should be understood that I wish to include within the claims of the patent warranted hereon all such modifications and changes as reasonably come within my contribution to the art.

We claim as our invention:

1. A method for the preparation of coal for the firing of a calcination installation having a preheating stage, a calcination stage and a sintering stage for the production of cement clinker comprising the steps of:

mixing the coal with an inert input gas having a predetermined temperature and composition;

pulverizing the coal, separating the pulverized coal into at least a stream of coaldust and a stream of exhaust gas bearing a selected residual of coaldust, blowing the exhaust gas into the calcination stage.

2. The method according to claim 1 having the further step of:

charging the exhaust gas at least partially with coal gravel before blowing the gas into the calcination stage, and wherein the exhaust gas, at least partially charged with coal gravel, is blown unfiltered into the calcination stage.

3. The method according to claim 2, wherein the exhaust gas is enriched with coal gravel so as to have a solids content between 30 $g/m^3$ and 300 $g/m^3$.

4. The method according to claim 3, wherein the degree of enrichment is determined by the extent of the temperature increase in the exhaust gas attained by means of the combustion of the coal content.

5. The method according to claim 1 including the further step of forming the stream of inert gas of a predetermined temperature by controlled mixing of two streams of input gas having differing temperature.

6. A method of preparing coal for use in selected apparatus using a pulverizer, at least one separator and transmission means operatively connecting the pulverizer and the separator, comprising the steps of:

mixing the coal with an inert input gas of a predetermined temperature, pulverizing the coal, separating the pulverized coal into a stream of gravel, a stream of dry coaldust, and a stream of exhaust gas still bearing a selected residue of unseparated coaldust, injecting at least some of the exhaust gas back into the pulverizer.

transporting at least some of the exhaust gas to an exhaust gas receiving apparatus for use therein.

7. The method according to claim 6 having the further step of charging the stream of exhaust gas with a predetermined amount of coal from the stream of gravel.

8. The method according to claim 7 wherein the step of charging comprises the step of charging the exhaust gas with an amount of coal gravel selected from a range of 30 grams per cubic meter to 300 grams per cubic meter.

9. The method according to claim 6 wherein the stream of gravel has a moisture content within a range of 5% to 8%.

10. The method according to claim 6 wherein the input gas comes from two different temperature sources and the method includes the additional step of:

adjusting the temperature of the input gas by mixing the gas from the two different temperature sources.

11. Apparatus for the preparation of coal for the firing of a calcination installation having a preheating stage, a calcination stage, and a sintering stage, the apparatus comprising:

means for pulverizing the coal, means for separating the pulverized coal into at least coaldust and exhaust gas bearing a residue of coaldust, means for injecting the exhaust gas, unfiltered, into the calcination stage of the installation.

12. The apparatus according to claim 11 wherein said means for pulverizing comprises a pulverizing mill having an input port connected to a regulated supply of coal and to a duct capable of supplying a stream of inert gas of a predetermined temperature.

13. The apparatus according to claim 11 wherein said means for separating includes an air-current-separator with an output port operatively connected with a first conduit to said means for pulverizing whereby said air-current-separator is operable to separate coal gravel from said exhaust gas and said coaldust at said output port and said first conduit is operable to inject at least some of the gravel back into said means for pulverizing.

14. The apparatus according to claim 13 wherein said output of said port air-current-separator is operatively connected by a second conduit to the calcination stage whereby at least some of the gravel from said air-current-separator may be injected into the calcination stage.

15. The apparatus according to claim 13 wherein said air-current-separator has an exhaust port operatively connected by further means for transmission to the calcination stage whereby at least a part of the exhaust gas from said air-current-separator may be injected into the calcination stage.

16. The apparatus according to claim 15 wherein said means for transmission includes a cyclone separator operative to remove selected quantities of coaldust from the exhaust gas from said air-current-separator before the exhaust gas is made available for injection into the calcination stage.

17. The apparatus according to claim 15 wherein said means for transmission forms a sealed means for transmission operative to retain the exhaust gas from the air-current-separator therein until the exhaust gas is injected into the calcination apparatus or said pulverizing mill.

18. The apparatus according to claim 16 wherein a third conduit and an associated control means are connected to said second conduit wherein the exhaust gas may be charged to a predetermined extent with the coal gravel.

19. Apparatus for the preparation of coal for use with related equipment comprising:

a means for the temporary storage of coal and for controlled feeding of the coal to be pulverized, a pulverizing mill with an input port and an output port, said input port being operatively connected through control means to said means for temporary storage and feeding, an inert gas input conduit operatively connected to said input port of said mill, a first separator operatively connected to said output port and capable of separating the pulverized coal output from said mill into at least a stream of gravel, at a first separator output port and coaldust laden exhaust gas at a first separator exhaust port, a second separator having an input port connected to said first separator exhaust port and capable of separating the coaldust laden exhaust gas from said first separator into coaldust, at a coaldust output port, and final exhaust gas bearing some predetermined quantity of unseparated coaldust at a second separator exhaust port, means for transmission and control capable of injecting at least a part of the final exhaust gas available at said second separator exhaust port into the related equipment.

20. The apparatus according to claim 19 having further, a conduit and a control means operatively connected between said means for transmission and said first separator output port whereby the stream of final exhaust gas may be charged with coal gravel to a predetermined degree.

21. The apparatus according to claim 20 wherein the exhaust gas is charged with coal gravel to a selected degree within a range of 30 grams/cubic meter to 300 grams/cubic meter.

22. The apparatus according to claim 19 having further means for coaldust storage operatively connected to said coaldust output port of said second separator.

23. The apparatus according to claim 19 having further, a first and a second gas conduit with a control means connected to said input conduit whereby inert gases of two different temperatures may be mixed to form an input gas stream having a predetermined temperature.

* * * * *